US005556052A

United States Patent [19]

Knaus

[11] Patent Number: 5,556,052

[45] Date of Patent: Sep. 17, 1996

[54] METHOD AND APPARATUS FOR WINDING

[76] Inventor: Dennis A. Knaus, 315 S. 45th St., Suite 1G, Philadelphia, Pa. 19104

[21] Appl. No.: 95,177

[22] Filed: Jul. 23, 1993

[51] Int. Cl.[6] ..... B65H 18/16; B65H 19/26

[52] U.S. Cl. ..... 242/412.3; 242/418.1; 242/413.9; 242/535.3; 242/542.4

[58] Field of Search ..... 242/418.1, 412.3, 242/413.9, 541.5, 541.6, 541.7, 541.4, 542.3, 542.4, 535, 535.2, 535.3, 535.4, 535.5

[56] References Cited

U.S. PATENT DOCUMENTS

| | | | |
|---|---|---|---|
| 1,673,823 | 6/1928 | Hinsdale | 242/542.4 X |
| 1,680,979 | 8/1928 | Gardner . | |
| 2,325,381 | 7/1943 | Edwards et al. . | |
| 3,057,572 | 10/1962 | Rockstrom et al. . | |
| 3,378,213 | 4/1968 | Habozit | 242/542.3 X |
| 3,433,429 | 3/1969 | Schnitzspahn | 242/542.3 X |
| 3,467,331 | 9/1969 | Pepmeier . | |
| 3,498,555 | 3/1970 | Leblond . | |
| 3,507,454 | 4/1970 | Suwa . | |
| 3,553,055 | 1/1971 | Janik . | |
| 3,561,692 | 2/1971 | Henry . | |
| 3,602,449 | 8/1971 | Sroka . | |
| 3,627,218 | 12/1971 | Feldschau . | |
| 3,662,967 | 5/1972 | Nowell et al. . | |
| 3,722,809 | 3/1973 | Leisring . | |
| 3,779,473 | 12/1973 | Edrinn . | |
| 3,820,732 | 6/1974 | McNeill . | |
| 3,857,524 | 12/1974 | Melead et al. | 242/542.3 X |
| 3,899,142 | 8/1975 | Hodges, Jr. et al. . | |
| 3,920,136 | 11/1975 | Talbert . | |
| 4,193,559 | 3/1980 | Ballard . | |
| 4,213,582 | 7/1980 | Rohner . | |
| 4,456,190 | 6/1984 | Kartunnen | 242/541.5 X |
| 4,541,585 | 9/1985 | Frye et al. | 242/542.4 |
| 4,715,552 | 12/1987 | Matsumoto . | |
| 4,729,520 | 3/1988 | Kataoka | 242/418.1 X |
| 5,028,011 | 7/1991 | Schiffers | 242/541 X |
| 5,249,758 | 10/1993 | Muller et al. | 242/541.5 X |
| 5,308,008 | 5/1994 | Ruegg | 242/541.7 |

FOREIGN PATENT DOCUMENTS

| | | |
|---|---|---|
| 0026335 | 4/1981 | European Pat. Off. . |
| 0332207 | 9/1989 | European Pat. Off. . |
| 0594850A1 | 5/1994 | European Pat. Off. . |
| 3629217A1 | 3/1988 | Germany . |
| 2117935 | 10/1983 | United Kingdom . |
| 2252765 | 8/1992 | United Kingdom . |

OTHER PUBLICATIONS

1236 Melliand Textiberichte International Textile Reports, 67 (1986) Aug., No. 8, Heildelberg, Deutschland.

*Primary Examiner*—John M. Jillions
*Attorney, Agent, or Firm*—Dickinson, Wright, Moon, Van Dusen & Freeman

[57] ABSTRACT

A method and apparatus for the preparation of a wound roll of a web of material is provided. The apparatus utilizes a surface windup device for automatically introducing a core onto a primary lay-on roll, and automatically cuts the web so that it can be attached around a new core. A primary lay-on roll feeds the web of material onto the rotating core. The core is driven by a secondary lay-on roll. The differential in speed between the primary and secondary lay-on rolls controls the tension of the web as it is wound. This invention also incorporates a retractable cutting roll and knife assembly that moves into position to cut the web of material, assists in transferring the web of material to a new core, and then retracts to a position that does not hinder winding the new roll of wound material. The winder is also equipped with an apparatus that ejects the wound roll from the hold-down clamps as a new roll is automatically started.

30 Claims, 2 Drawing Sheets

METHOD AND APPARATUS FOR WINDING

FIELD OF THE INVENTION

This invention relates generally to an improved method and apparatus for winding a web of material into a roll wherein the tension and compression of the web of material is controlled as it is wound, and wherein, when the roll is finished, it is ejected, and the web of material is automatically cut and transferred to a new roll.

BACKGROUND OF THE INVENTION

Heretofore, in winding or rewinding a web, a dancer roll has been used for the purpose of absorbing tension variation and thereby controlling tension in the web. However, dancer rolls can create creases in thinner films so that the edges of the wound films cannot be aligned. Furthermore, dancer rolls imparts tension into the web of material being wound. In some winders, a method of adjusting tension by controlling the torque of a motor shaft is generally employed or the tension is detected by means of a fixed roll.

A typical means for detecting tension exerted upon a sheet and controlling the same is by the use of a dancer roll. The tension exerted upon the sheet is detected as an electric signal derived from a displaced dancer roll actuating a potentiometer or the like. After comparing this detected signal with a preset value, a driving force is controlled so as to bring the dancer roll back to its set position, thereby exerting tension upon the sheet to a predetermined value. This type of apparatus has a disadvantage in that the follow-up characteristic of a dancer roll, i.e., its response to film tension, is not sufficiently high. In addition, by definition, there is always some amount of tension that the dancer must impart into the web to properly monitor and operate the drive control. Thus, a typical dancer arrangement cannot be used to achieve zero tension in the web being wound.

Another method employed to control tension is an apparatus in which current through a motor for driving a spool or core is detected (when the tension of a sheet being taken up becomes small, the torque of the motor is reduced and thus the current through the motor is reduced) and thereby the tension exerted upon the sheet is detected. In order to compare the tension of the sheet with a preset value, the detected current signal is led to a current control system in which the current signal is compared with a preset current value for the motor in order to control the motor current. However, this type of apparatus also involves problems in that the response characteristic for tension control is poor because of the inertia of the mechanical system, and the sheet is unevenly stretched owing to variations in tension.

Assuming that controls similar to those in the aforementioned winders are employed in a rewinder, since such material as sound film is generally kept intact for several days for aging purposes before it is rewound by a rewinder, air wound jointly with the film escapes resulting in an eccentric deformation of the wound film. As a result, variation in tension is far larger than that which occurs upon winding, and the rewinding becomes impossible.

As described above, there are many disadvantages in the prior art methods. More particularly, in a rewinder having a dancer roll, tension of a film cannot be measured precisely because of the mass of the dancer roll, and the r.p.m. of the spool becomes equal to or higher than the resonant frequency of the vibration system consisting of the mass of the dancer roll, the bracket supporting same and the spring or other type of tensioning mechanism used for the dancer roll. Thus, not only does the capability of detecting tension diminish, but also the rewinding operation per se becomes impossible because of the vibration of the dancer roll. As stated previously, a wound film is kept intact for several days for the purpose of aging.

Furthermore, assuming that controls similar to those in the aforementioned winders are employed in a rewinder, since such material as polyethylene foam or the like, go through an aging process in which the web of material experiences post expansion, and since the web of material wound into a roll is confined to a given space, any expansion of the web of material that does take place is mirrored by an equal amount of compression of the web of material in other parts of the roll. In general, the outer layers of the web in the roll will expand and as they expand, they compress the inner layers of the web within the roll. As a result, variation in thickness in the web of material tends to remain in the web of material even after its is rewound using conventional winding methods.

In addition, most thermoplastic film or sheet experiences some stretching during processing. If controls similar to those in the aforementioned winders are employed in a winder or a rewinder, the amount of stretching that occurs tends to remain in the of material until it is unwound and left in a free state without any external forces. Over time the of material will tend to contract and relax in the direction of the stretch and assume a new dimensional geometry. If a product is die cut, for instance, before the product has reached a relaxed state, then dimensions of the cut product will change once the product relaxes and its dimensions may exceed the acceptable tolerances and it may have to be discarded as scrap.

Other post processing operations such as skiving or thermoforming often requires a material that has low stress in it. However, using controls similar to those in the aforementioned winders or rewinders, some stress and orientation can be imparted into the material.

Winders are an important apparatus in many manufacturing processes, such as in the manufacture of cable, film, sheet or other strand or web type materials which have many beneficial industrial and commercial uses particularly in the packaging industry. The method and apparatus employed by winders are described in the U.S. patents listed below as well as in other literature pertaining to the design and method of operation.

U.S. Pat. No. 3,429,517 discloses a double layer winding device, especially for textiles webs, which operates in conformity with the duplex winding with two hank rollers of changing direction of rotation for storing the goods which are withdrawn in a continuous uninterrupted process.

U.S. Pat. No. 3,503,526 describes an apparatus for winding or unwinding continuous webs of non-conductive material, the apparatus incorporating an alpha particle-emitting device directed toward a winding or unwinding roll or web beyond the point of tangency between the web and roll.

U.S. Pat. No. 3,506,211 discloses an apparatus for cutting and coiling webs of paper, corrugated cardboard, and the like, comprising a coiling bar in the form of a shaft which is activated at one end and mounted at the other end in a removable bearing which makes use of a mechanical movable arrangement along the winding bar.

U.S. Pat. No. 3,514,046 describes an apparatus including a pair of windup reels selectively positionable to be driven for winding up a strip of material received from an adjacent processing apparatus.

U.S. Pat. No. 3,514,047 describes an apparatus including a utilized surface windup device for automatically introducing a core within the nest of the winding drums, cinching the end of a web around the core, winding the web onto the core to form a roll, and ejecting the wound roll from the nest. The reference also discloses a method for automatically attaching the trailing end of the web to the outer convolution of a wound roll and a method for automatically cleaning the winding drum.

U.S. Pat. No. 3,602,448 describes an apparatus for winding a web onto a rotating reel, an ironer assembly for smoothing the web as it is added to the reel, including an ironer roll which rides on the reel, a pivotally suspended frame larger in mass than the ironer roll, and springs under compression between the frame and roll for resiliently supporting the frame on the roll, so that the weight of the frame augments the pressure exerted by the roll on the web.

U.S. Pat. No. 3,630,462 describes a web winding an apparatus including a reel on which a roll being wound is contacted by a rider roll. A potentiometer associated with the rider roll monitors the roll buildup and controls a DC-indexing motor to rotate the winding-roll away from the rider roll to maintain substantially constant web tension. A circuit controls the acceleration and deceleration of the indexing motor as the rolls are being changed to permit web tension to be maintained constant.

U.S. Pat. No. 3,677,484 describes a thin layer material having a large width which can be wound up around a winding core by continuously supplying and inserting an elongated continuous yarn-like material, and which transverses the thin layer material, in between one wound layer and another, to leave a clearance along the inserted yarn-like material.

U.S. Pat. No. 3,749,328 describes an air-permeable member which is secured to the end of a tube carried by a pivotally-mounted guide arm, said member being positioned between the flanges of a tape reel and mechanically biased toward the reel hub as a strip of tape is wound onto the hub.

U.S. Pat. No. 3,794,268 describes a method and apparatus for winding a hollow, flexible tubular material in a manner which permits the tubular material to be removed from its support and simultaneously filled continuously for packaging or other purposes.

U.S. Pat. No. 4,050,642 describes a method and apparatus for winding a film wherein a pressurized jet of air is directed onto a surface of an unsupported portion of the film being wound or rewound.

The above mentioned patents do not disclose the method and apparatus for reducing the tension of the sheet or web as it is wound, or reducing roll compression exerted by a lay-on roll when surface winding through the use of a secondary lay-on roll with a differential speed adjustment relative to the primary lay-on roll speed, or the use of a torque motor to control the pressure exerted between the roll being wound and the lay-on roll that turns the roll being wound. When less tension or compression was desired in a material wound on a roll, it has previously been necessary to loosen the material on the wound roll after winding or rewind the roll in a secondary operation off-line. This additional procedure adds labor, and therefor costs, to the product, and moreover, results in added handling and exposure of the material to the potential of marking, soiling, crimping, and/or types of damage that result in poor aesthetic and/or functional qualities, reducing the value of the material and/or its structure. Furthermore, these patents do not disclose the use of a roll surface made up of a material that is softer than the web of material being wound and thus the roll with a soft covering behaves more like a flat surface which reduces point to point contact that most surface winders exhibit. In addition, a tucking device or tucking roll is not disclosed in the above patents nor is a retractable cutting roll and knife assembly to cut the web of material.

SUMMARY OF THE INVENTION

This invention has been proposed in order to eliminate the aforementioned disadvantages in the prior art, and it is an object of the present invention to, provide a novel method of winding or rewinding which eliminates many of the problems encountered with the current winding technologies and techniques, even if a web of material is wound at very high speed. This patent provides a technique for reducing the tension of the sheet or web as it is wound and reduces roll compression exerted by a lay-on roll when surface winding. With less tension and compression being imparted into the web of material wound on a roll when the method and apparatus described in this patent is used, the need of loosening the web of material on the wound roll after winding is reduced or eliminated as well as the need to rewind the roll in a secondary operation off-line. The elimination of these additional procedures reduces labor, and therefor the cost of wound products, and moreover, results in less handling and exposure of the web of material to the potential of marking, soiling, crimping, and or types of damage that result in poor aesthetic and/or functional qualities, thereby improving the value of the web of material and/or its structure.

According to one feature of the present invention, the aforementioned object can be achieved during the winding or rewinding process by the use of a secondary lay-on roll to drive the rotation of the winding roll, in conjunction with a primary lay-on roll that is in close proximity to the winding roll, but not touching it, and whose function, in general, is to present the web onto the winding roll at a speed equal to or greater than the surface speed of the outside surface of the winding roll. The winding roll's rotation or speed is controlled by the secondary roll. When the winding roll's surface speed moves slower than the speed of the web of material it is winding, then the web will be wound with decreased tension.

BRIEF DESCRIPTION OF THE DRAWINGS

FIG. 1 is a schematic cross-section of a winding apparatus for practicing the invention when in the running position.

FIG. 2 is a schematic cross-section of a winding apparatus, with a cutting roll that has a dedicated motor, in the roll change position.

FIG. 3 is a schematic cross-section of a winding apparatus, with a cutting roll that is driven by the primary lay-on roll, in the roll change position.

DETAILED DESCRIPTION OF THE INVENTION

Figure 1:
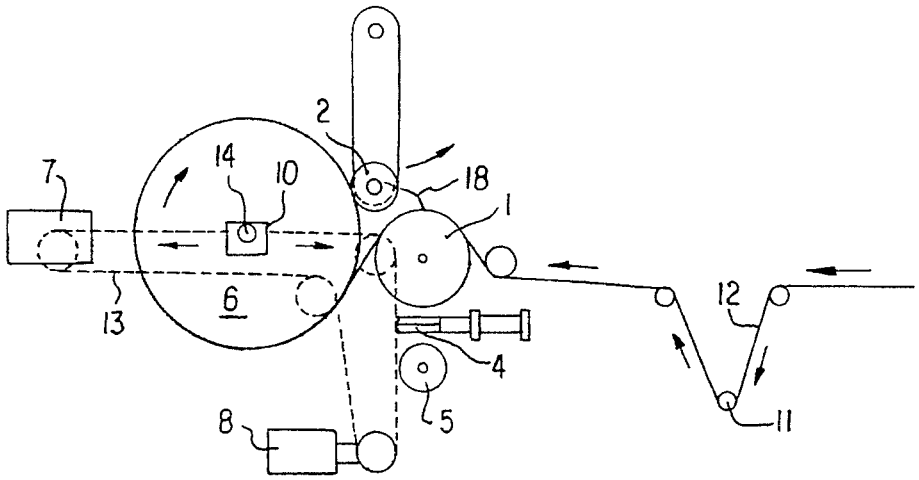
FIGS. 1, 2 and 3 are schematic representations of the disclosed winder.
Figure 1A:
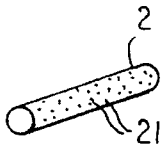
FIG. 1*a* and 1*b* are perspective views of the secondary lay-on roll.
Figure 1B:
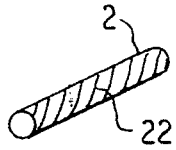
Figure 2:
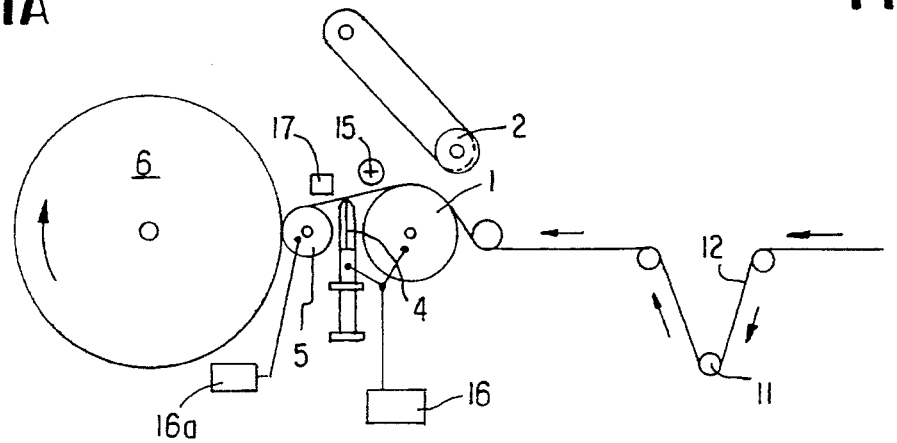
Figure 3:
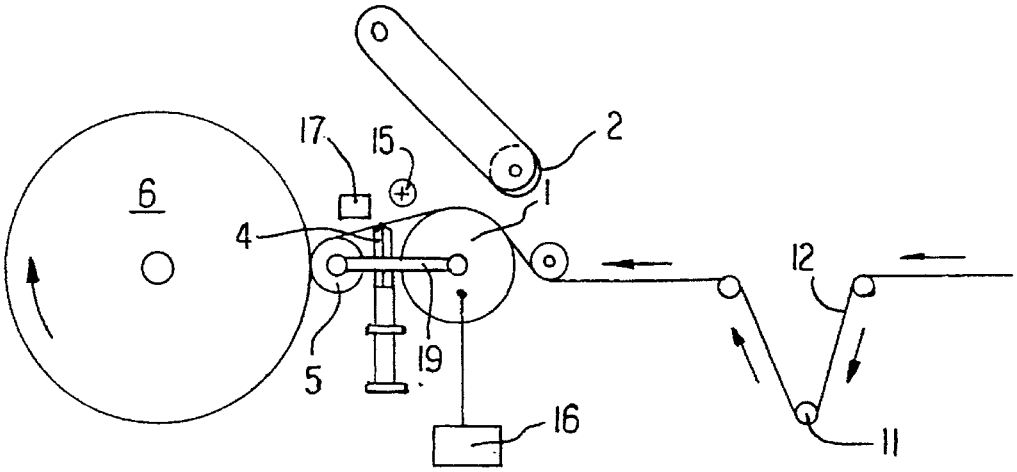
Figure 4:
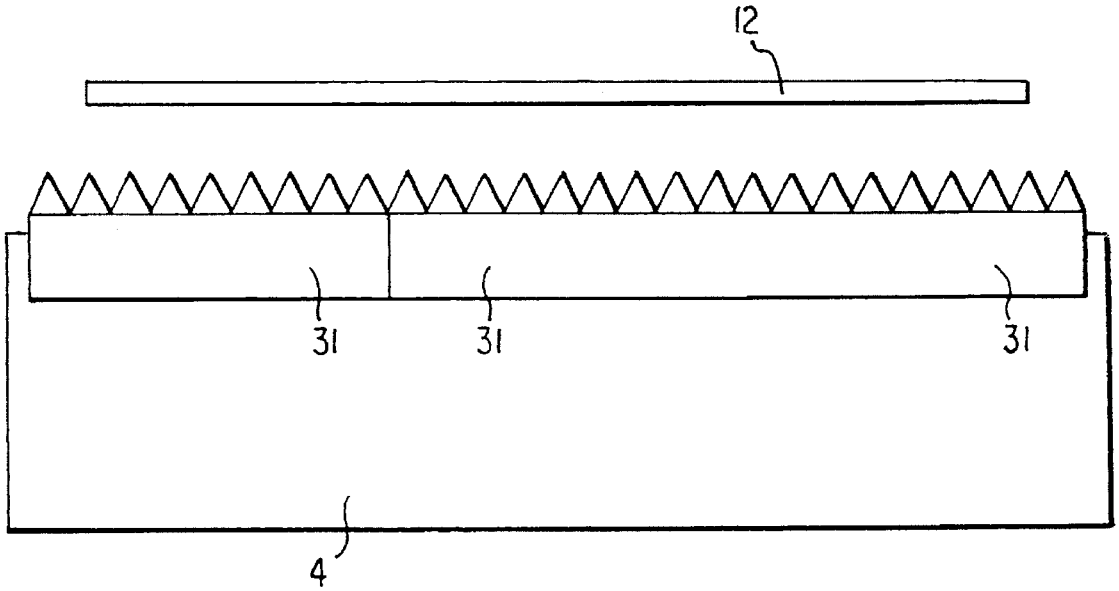
FIG. 4 is a schematic representation of the cutting blade.

The web of material 12 being wound is wrapped around the primary lay-on roll 1. Preferably the web of material 12 being wound has at least a 90° wrap around the primary lay-on roll 1, although less of a wrap can be used. The wrap refers to the angular distance in which the web of material 12 is against a roll's surface. The primary lay-on roll 1 presents the web of material 12 to the roll of material 6 being wound. The primary lay-on roll 1 is rotated by is own motor 16 (see FIG. 3) and its speed is controlled by a potentiometer or similar device. The secondary lay-on roll may also be provided with its own drive. The drives of the primary and secondary lay-on rolls may be electronically connected so that their speeds are synchronized at a set ratio as the primary roll speed fluctuates. Some embodiments are also contemplated wherein the speed ratio is adjustable. In some arrangements the speed of the primary lay-on roll 1 is controlled or regulated by a dancer roll 11 whose movement varies with the tension of web of material being wound 12. The pressure the dancer roll 11 exerts against the web of material 12 can be varied to increase or decrease the tension of the web of material 12 being wound.

After the web of material 12 is placed onto the roll of material 6 being wound, it moves in unison with the roll of material 6 being wound. After the web of material 12 is placed on roll of material 6 being wound it encounters the secondary lay-on roll 2. The rotation of the secondary lay-on roll 2 causes the roll of material 6 being wound to rotate at the same approximate surface speed as the surface speed of the secondary lay-on roll 2. The secondary lay-on roll 2 has its own drive motor. The speed of the secondary lay-on roll 2 is regulated as a function of the ratio, which is adjustable, to the speed of the primary lay-on roll 1. Therefore, as the speed of the primary lay-on roll 1 increases or decreases, the secondary lay-on roll 2 increases or decreases the same amount so that primary lay-on roll 1 and the secondary lay-on roll 2 maintain the same relative speed ratio by the regulating means 18. In addition, since the secondary lay-on roll 2 can be run at a speed that is slower or faster speed relative to the speed of the primary lay-on roll 1, the speed of the roll of material 6 being wound can be adjusted by changing the speed of the secondary lay-on roll 2 to increase or decrease tension in the web of material 12 as it is placed onto the roll of material 6 being wound, thus providing a method to control and manipulate tension of the web of material 12 in the roll heretofore unknown. A further benefit can be achieved by covering the secondary lay-on roll 2 with soft material 22 that can compress when pushed against the roll of material 6 being wound. If the secondary lay-on roll 2 covering compresses, the surface it presents to the roll of material 6 being wound appears flatter. A flatter appearing secondary lay-on roll 2 reduces the compression of the web of material 12 on the roll of material 6 being wound that would normally occur in point to point contact of two rolls especially if the secondary lay-on roll 2 had a firmer material on it. In one embodiment, the material on the secondary lay-on roll is a surface with strands protruding from it or a like material that exhibits lower compression properties than the web of material being wound. The secondary lay-on roll may have an area on the surface which has strands 21 protruding therefrom.

The roll of material 6 being wound is mounted on a shaft 14 whose ends rest in holders 10. The holders 10 support the shaft 14 at both ends and allow the roll of material 6 being wound to rotate as the web of material 12 is wound onto it. As the web of material 12 is wound on the roll of material 6, the diameter of the roll of material 6 being wound increases thereby pushing the holders 10 further from secondary lay-on roll 2 while the roll of material 6 remains in contact with and continues to be turned by the secondary lay-on roll 2. The holders 10 are connected to one another by a chain and jack-shaft assembly. The movement of the assembly is controlled by a torque motor 8. The torque motor 8 can move the holders in or out, or it can control the pressure exerted by the roll of material 6 being wound against the secondary lay-on roll 2.

Once the desired length of web of material 12 is wound onto the roll of material 6 being wound a retractable cutting roll 5 and cutting knife 4 are moved into position to cut the web of material 12 and transfer it to a start-up roll 3 so that a new roll of material 6 can be wound. The cutting roll may be driven by the primary roll through the use of a chain 19, belt, gear or the like, and possibly in conjunction with a variable speed reducer. The cutting roll may also be driven by its own motor **16*a* and at a speed that is created mechanically or electronically and related by to the speed of the primary roll. The cutting knife 4, which may be retractable, may have a geometry resembling a multitude of small individual pointed blades 31 in a row and directed towards the path of the web of material 12 being wound and forced through the path of the web of material, thereby cutting the material and directing it to the new core that the web of material will be wound on. A tucking device 17 may be used to aid in the transfer of the web of material onto the empty core. A roll, such as the secondary lay-on roll, may also be used for this purpose. After the transfer of the web of material 12 is made to the start-up roll of material 3 and a new roll of material 6 is winding, the cutting roll 5 and cutting knife 4 are retracted and moved to the run position where they will not hinder the winding of the new start-up roll 3**.

What is claimed is:

1. An apparatus for winding, comprising:

a winding roll for rotatingly accumulating a web of material;

a primary roll, in close proximity to, but spaced apart from, said winding roll, for feeding a web of material onto said winding roll at a speed not less than the surface speed of the exterior surface of said winding roll;

a secondary roll for driving said winding roll, said secondary roll being in rotatable contact with said winding roll; and a motor for driving said secondary roll;

wherein said motor maintains an essentially constant speed ratio between said primary and secondary rolls.

2. The apparatus of claim 1, wherein the speed ratio between said primary and secondary rolls is adjustable.

3. The apparatus of claim 1, wherein the surface of said secondary roll comprises a material that compresses more than the material being wound.

4. The apparatus of claim 1, wherein the material disposed on said secondary roll comprises compressible strands.

5. An apparatus for winding, comprising:

winding means for accumulating a web of material;

distributing means, in close proximity to said winding means, for distributing the web of material onto said winding means;

driving means for rotating said winding means, said driving means being in direct contact with the material accumulated on said winding means; and regulating means for maintaining a constant surface speed ratio between said driving means and said distributing means;

wherein said distributing means is spaced apart from, but in close proximity to, the web of material accumulating on said winding means, and wherein said distributing means is in direct contact with the web of material being distributed onto said winding means.

6. The apparatus of claim 5, wherein said distributing means is a cylindrical roll.

7. The apparatus of claim 5, wherein said driving means is a cylindrical roll.

8. The apparatus of claim 6, wherein the web of material is introduced around said distributing means at at least a 90° wrap.

9. The apparatus of claim 5, wherein said regulating means is a motor which operates said driving means and which is responsive to changes in the surface speed of said distributing means.

10. The apparatus of claim 5, wherein the tension of the web of material being wound is controlled by a dancer roll.

11. The apparatus of claim 5, wherein the tension in the web of material is adjustable by changing the surface speed of said driving means relative to the surface speed of said distributing means.

12. The apparatus of claim 5, wherein said driving means is equipped with cushioning means for reducing the pressures associated with point contact, and wherein said cushioning means compresses when pushed against the roll of material being wound.

13. The apparatus of claim 12, wherein said cushioning means is a foam having lower compression properties than the material being wound.

14. The apparatus of claim 12, wherein said cushioning means comprises an area on the surface of said driving means which has strands protruding from it and which exhibits lower compression properties than the material being wound.

15. The apparatus of claim 5, further comprising:

severing means for severing the web of material when the windup roll is sufficiently full.

16. The apparatus of claim 5, wherein said severing means is a retractable cutting roll and knife assembly.

17. The apparatus of claim 16, wherein said retractable cutting roll is driven by said distributing means.

18. The apparatus of claim 16, wherein said retractable cutting roll is driven by its own motor and is synchronized with the surface speed of said distributing means.

19. The apparatus of claim 16, wherein said knife assembly comprises a plurality of blades aligned in a row and directed towards the path of the material being wound.

20. The apparatus of claim 17, wherein said retractable cutting roll is driven by said distributing means in conjunction with a variable speed reducer.

21. The apparatus of claim 15, further comprising:

transfer means for transferring the web of material to a new start-up roll after the web is cut so that a new roll of material can be wound.

22. The apparatus of claim 21, wherein said transfer means is a roll.

23. The apparatus of claim 21, wherein said transfer means is also said driving means.

24. The apparatus of claim 21, wherein said transfer means is a tucking device.

25. The apparatus of claim 5, further comprising:

torque means for controlling the force applied by said winding means against said driving means.

26. The apparatus of claim 25, wherein said torque means is reversible.

27. The apparatus of claim 5, wherein said driving means and said distributing means have separate drives, and wherein said drives are synchronized so that their surface speeds are maintained at a constant ratio.

28. An apparatus for winding, comprising:

a winding roll for rotatingly accumulating a web of material;

a primary roll for feeding a web of material onto said winding roll at a speed not less than the surface speed of the outside surface of said winding roll, said primary roll being in close proximity to, but not touching, said winding roll;

at least one dancer roll for exerting adjustable pressure against the web of material before the web passes over said primary roll;

a secondary roll for driving said winding roll, said secondary roll being in rotatable contact with the outside surface of said winding roll and comprising a surface material that is more compressible than the material being wound;

a motor for driving said secondary roll;

regulating means for regulating said motor so as to maintain an essentially constant speed ratio between said primary and secondary rolls; and cutting means for cutting the web of material;

wherein the web of material has at least a 90° wrap around said primary roll.

29. The apparatus of claim 28, wherein said surface material on said secondary roll comprises compressible strands.

30. The apparatus of claim 28, wherein the speed of said primary roll is controlled by said dancer roll.

* * * * *